US007128139B2

(12) United States Patent
Oballa et al.

(10) Patent No.: US 7,128,139 B2
(45) Date of Patent: Oct. 31, 2006

(54) EXTERNAL RIBBED FURNACE TUBES

(75) Inventors: Michael C. Oballa, Cochrane (CA); Leslie Wilfred Benum, Red Deer (CA); Marvin Harvey Weiss, Calgary (CA)

(73) Assignee: Nova Chemicals (International) S.A. (CH)

( * ) Notice: Subject to any disclaimer, the term of this patent is extended or adjusted under 35 U.S.C. 154(b) by 153 days.

(21) Appl. No.: 10/965,089

(22) Filed: Oct. 14, 2004

(65) Prior Publication Data

US 2006/0081364 A1 Apr. 20, 2006

(51) Int. Cl.
*F28F 1/20* (2006.01)

(52) U.S. Cl. ..... 165/181; 29/890.046

(58) Field of Classification Search ..... 165/181–185
See application file for complete search history.

(56) References Cited

U.S. PATENT DOCUMENTS 4,753,833 A * 6/1988 Fishgal et al. ..... 165/182
5,669,441 A * 9/1997 Spencer ..... 165/184
5,950,718 A 9/1999 Sugitani et al. ..... 165/133
6,644,388 B1 11/2003 Kilmer et al. ..... 165/133
6,808,017 B1 * 10/2004 Kaellis ..... 165/181

OTHER PUBLICATIONS

R.L. Webb, E.R.G. Eckert and R.J. Goldstein, Heat Transfer and Friction in Tubes with Repeated-Rib Roughness, Int. J. Heat Mass Transfer., vol. 14, pp. 601-617, 1970, gbx Enhanced Heat Exchangers for Process Heaters, Published Nov. 2001 by the Office of Industrial Technologies, U.S. Dept. of Energy.

Seyhan Uygur Onbasioglu, and Huseyin Onbasiouglu, On Enhancement of Heat Transfer with Ribs, Applied Thermal Engineering 24 (2004) pp. 43-57.

* cited by examiner

*Primary Examiner*—Teresa J. Walberg
(74) *Attorney, Agent, or Firm*—Kenneth H. Johnson

(57) ABSTRACT

In a radiant heating box there is a convection current which flows over the surface of tubes in the box. Adding ribs to the external surface of vertical tubes provides an enhancement to the heat transfer by convection and increases the heat transfer to the tubes.

39 Claims, 3 Drawing Sheets

EXTERNAL RIBBED FURNACE TUBES

FIELD OF THE INVENTION

The present invention relates to tubes used in high temperature applications. More particularly the tubes are in a radiant fired heater where heat transfer is mainly by radiation but there is also convective heat transfer. The invention provides significant improvement to the convective heat transfer and may affect the radiant heat transfer

BACKGROUND OF THE INVENTION

Tube and plate heat exchangers are well known. Typically a hot fluid passes through a tube which has a number of plates or fins attached to it. Generally the plates or fins have a dimension of several times the diameter of the tube and the fins are spaced close together. The purpose is to transfer heat to the plate or fin by conduction and then have a fluid such as air extract the heat from the fluid by convection. The present invention does not use a finned heat exchanger.

U.S. Pat. No. 6,644,388 issued Nov. 11, 2003 to Kilmer et al., assigned to Alcoa Inc., discloses a sheet product which has improved heat transfer properties. The sheet has a number of textured features having a dimension from about 1 to 50 microns. Sheet can be used as fins on a heat exchanger or can be made into tubes. The tubes can be textured on the inside or on the outside. However there are fins on the exterior of the tube (Col. 4, lines 34 and 35). The patent teaches that pipe made from a rolled sheet is used in cooling applications such as radiators, heaters, evaporators, oil coolers, condensers and the like. The patent doesn't suggest the micro textures could be used on the surface of a pipe which is to be heated.

The paper "On Enhancement of Heat Transfer with Ribs" Applied Thermal Engineering 24 (2004) 43–57, discloses putting ribs on the surface of, for example, a fin. The heat transfer from the fin improves as a function of a number of factors including rib height and angle of inclination of the rib. However, the paper does not suggest ribs could be applied to the external surface of a pipe taking up heat from an environment.

The paper "Enhanced Heat Exchangers for Process Heaters" Published November 2001 by the Office of Industrial Technologies teaches the use of dimpled tubes in the convection section of a heat exchanger. The dimples produce a vortex effect which may increase heat transfer up to about 30% compared to a flat tube. The reference does not teach or suggest using ribs rather than dimples.

The present invention seeks to provide a simple solution to improving the heat transfer (up take) in a tube carrying a chemical to be process at elevated temperature such as tubes in the radiant section of an ethylene furnace.

SUMMARY OF THE INVENTION

The present invention provides a method to increase by at least 5% the convection heat transfer from an external heat transfer medium to a vertical surface selected from the group consisting of metal or ceramic in a radiant fired heater box, and increasing the total heat flux into the surface by at least 2%, used to heat an internal process fluid by increasing the turbulent flow of the heat transfer medium at the external surface comprising forming on the external surface ribs which have:

(i) a ratio of the rib height to the diameter of the tube (e/D) from 0.05 to 0.35;

(ii) a ratio of the distance between the leading edge of consecutive ribs to rib height (P/e) less than 40; and (iii) a ratio of the thickness of the rib to the height of the rib (t/e) from 0.5 to 3.

The present invention further provides tube used in a chemical reaction requiring the input of heat to the reaction having on the external surface of the tube ribs which have:

(i) a ratio of the rib height to the diameter of the tube (e/D) from 0.05 to 0.35 preferably from 0.1 to 0.35;

(ii) a ratio of the distance between the leading edge of consecutive ribs to rib height (P/e) less than 40, preferably from 2 to 20, most preferably from 4 to 16; and (iii) a ratio of the thickness of the rib to the height of the rib (t/e) from 0.5 to 3 preferably from 1 to 2.

The present invention further comprises a process to make a rib on a metal tube comprising one or more processes selected from the group consisting of casting, machining, and welding.

The present invention additionally comprises a process to make a rib on a ceramic tube comprising one or more processes selected from the group consisting of casting, machining or depositing additional material.

DETAILED DESCRIPTION

Figure 1:
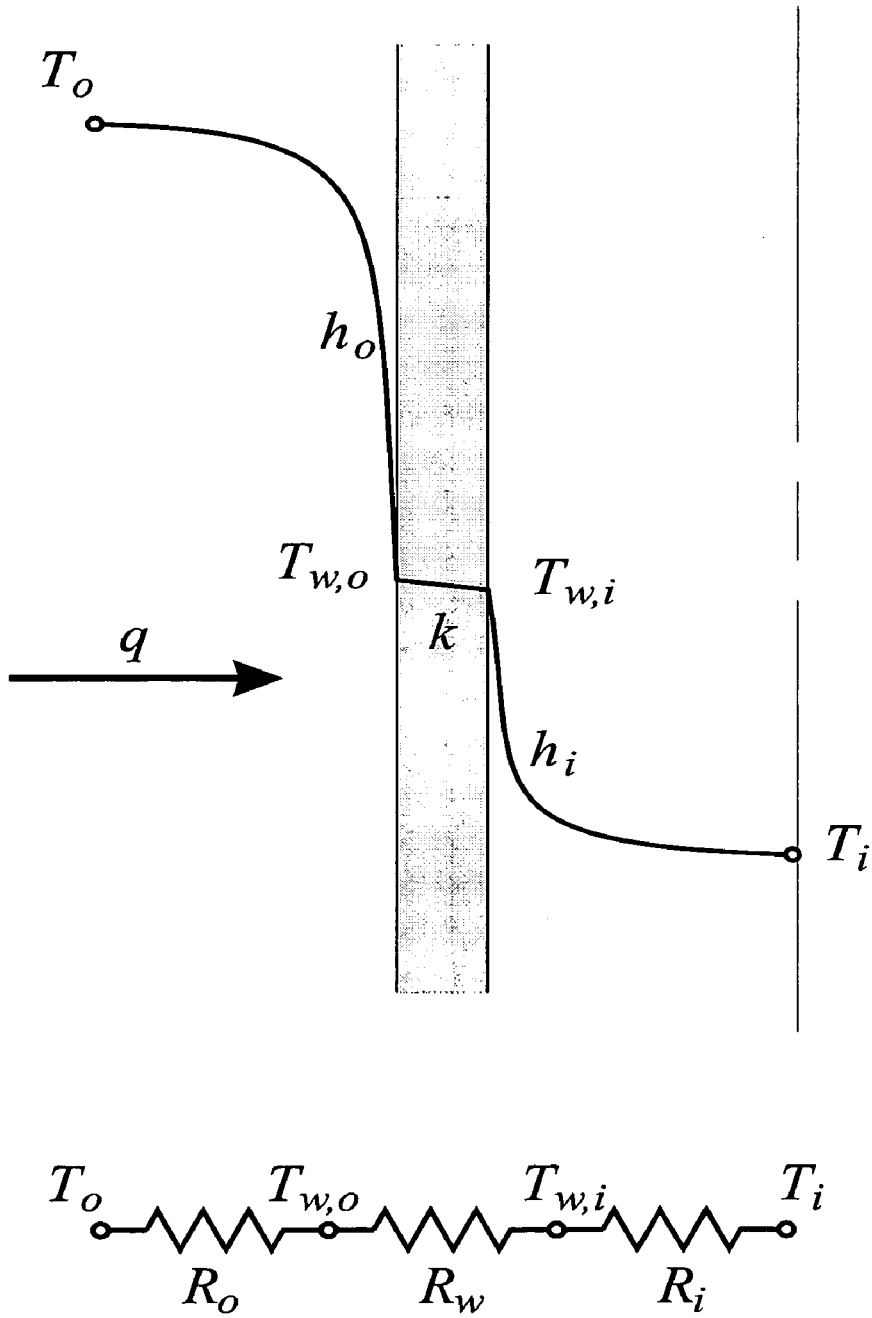
FIG. 1 is a thermal resistance analogy to the heat transfer through a furnace tube wall.

The tubes to which the present invention may be applied are typically vertical tubes carrying a mixture of one or more reactants requiring heat to drive a reaction to completion or to get the required product. The tubes are typically heated using convection heating or a combination of convection and radiant heat. For example, in the hot box of an ethylene cracker, the tubes inside a furnace are operated at temperatures from about 800° C. to about 1150° C., typically from about 950 to 1100° C.

The tube may be made of from a metal selected from the group consisting of stainless steel, cast alloys, wrought alloys, carbon steel and ceramic. These terms are well known to those skilled in the art.

The steel may be a carbon steel or a stainless steel which may be selected from the group consisting of wrought stainless, austentic stainless steel and HP, HT, HU, HW and HX stainless steel, heat resistant steel, and nickel based alloys. The steel may be a high strength low alloy steel (HSLA); high strength structural steel or ultra high strength steel. The classification and composition of such steels are known to those skilled in the art.

In one embodiment the steel is stainless steel, preferably heat resistant stainless steel typically comprises from 13 to 50, preferably 20 to 50, most preferably from 20 to 38 weight % of chromium. The stainless steel may further comprise from 20 to 50, preferably from 25 to 50 most preferably from 25 to 48, desirably from about 30 to 45 weight % of Ni. The balance of the stainless steel is substantially iron.

The present invention may also be used with nickel and/or cobalt based extreme austentic high temperature alloys (HTAs). Typically the alloys comprise a major amount of nickel or cobalt. Typically the high temperature nickel based alloys comprise from about 50 to 70, preferably from about 55 to 65 weight % of Ni; from about 20 to 10 weight % of Cr; from about 20 to 10 weight % of Co and from about 5 to 9 weight % of Fe and the balance one or more of the trace elements noted below to bring the composition up to 100 weight %. Typically the high temperature cobalt based alloys comprise from 40 to 65 weight % of Co, from 15 to 20 weight % of Cr; from 20 to 13 weight % of Ni; less than 4 weight % of Fe and the balance one or more trace elements as set out below and up to 20 weight % of W. The sum of the components adding up to 100 weight %.

In some embodiments of the invention the steel may further comprise at least 0.2 weight %, up to 3 weight % typically 1.0 weight %, up to 2.5 weight % preferably not more than 2 weight % of manganese from 0.3 to 2, preferably 0.8 to 1.6 typically less than 1.9 weight % of Si; less than 3, typically less than 2, weight % of titanium, niobium (typically less than 2.0, preferably less than 1.5 weight % of niobium) and all other trace metals; and carbon in an amount of less than 2.0 weight %.

In one embodiment of the invention the interior surface of the tube may have a surface which is resistant to coking.

One embodiment of a surface which is resistant to coking comprises a spinel outer surface or over coating having a thickness from 1 to 10, preferably from 2 to 5 microns and is selected from the group consisting of a spinel of the formula $Mn_xCr_{3-x}O_4$ wherein x is from 0.5 to 2; preferably x is from 0.8 to 1.2, most preferably x is 1 and the spinel has the formula $MnCr_2O_4$.

The overall surface layer or over coating have a thickness from 2 to 30 microns. The surface layers at least comprise the outer surface preferably having a thickness from 1 to 10, preferably from 2 to 5 microns. The chromia layer generally has a thickness up to 25 microns generally from 5 to 20, preferably from 7 to 15 microns. As noted above the spinel overcoats the chromia geometrical surface area. There may be very small portions of the surface which may only be chromia and do not have the spinel overlayer. In this sense the layered surface may be non-uniform. Preferably, the chromia layer underlies or is adjacent not less than 80, preferably not less than 95, most preferably not less than 99% of the spinel.

Such a coating or over surface may be applied or created in a number of ways, such as by spray techniques using conventional coating processes including detonation gun spraying, cement packing, hard facing, laser cladding, plasma spraying, (e.g. low pressure plasma spraying), physical vapour deposition methods (PVD including cathodic arc sputtering, DC, RF, magnetron), flame spraying (e.g. high pressure/high velocity Oxygen Fuel (HP/HVOF), electron beam evaporation, and electrochemical methods. These methods could also be used to apply ribs to a ceramic or metal surface. Combinations of these methods may also be used. Typically a powder having the targeted composition is applied to the substrate.

The surface may be generated by heat treatment. One such heat treatment comprises:

(i) heating the stainless steel in a reducing atmosphere comprising from 50 to 100, preferably 60 to 100 weight % of hydrogen and from 0 to 50, preferably from 0 to 40 weight % of one or more inert gases at rate of 100° C. to 150° C., preferably from 120° C. to 150° C., per hour to a temperature from 800° C. to 1100° C.;

(ii) then subjecting the stainless steel to an oxidizing environment having an oxidizing potential equivalent to a mixture of from 30 to 50 weight % of air and from 70 to 50 weight % of one or more inert gases at a temperature from 800° C. to 1100° C. for a period of time from 5 to 40, preferably from 10 to 25, most preferably from 15 to 20 hours; and (iii) cooling the resulting stainless steel to room temperature at a rate so as not to damage the surface on the stainless steel.

Inert gases are known to those skilled in the art and include helium, neon, argon and nitrogen, preferably nitrogen or argon.

Preferably the oxidizing environment in step (ii) of the process comprises 40 to 50 weight % of air and the balance one or more inert gases, preferably nitrogen, argon or mixtures thereof.

In step (iii) of the process the cooling rate for the treated stainless steel should be such to prevent spalling of the treated surface. Typically the treated stainless steel may be cooled at a rate of less than 200° C. per hour.

Another surface resistant to coking comprise from 90 to 10 weight %, preferably from 60 to 40 weight %, most preferably from 45 to 55 weight % the spinel (e.g. $Mn_xCr_{3-x}O_4$ wherein x is from 0.5 to 2) and from 10 to 90 weight %, preferably from 40 to 60 weight %, most preferably from 55 to 45 weight % of oxides of Mn, Si having a nominal stoichiometry selected from the group consisting of MnO and $MnSiO_3$ and mixtures thereof.

If the oxide has a nominal stoichiometry of MnO, the Mn may be present in the surface in an amount from 1 to 50 atomic %. Where the oxide is $MnSiO_3$, the Si may be present in the surface in an amount from 1 to 50 atomic %.

The surface resistant to coking may have a thickness from about 10 to 5,000 microns typically from 10 to 2,000, preferably from 10 to 1,000 desirably from 10 to 500 microns. Typically the substrate surface covers at least about 70%, preferably 85%, most preferably not less than 95% desirably not less than 98.5% of the surface of the stainless steel substrate.

The surface resistant to coking may be generated using the above noted heat treatment or applied using the above noted techniques.

The tubes or ribs may be a ceramic material useful at the above noted temperatures. One ceramic, which may be applicable is silicon carbide.

The ribs may be prepared on the external surface of the tube by any number of methods (including deposition of further material as noted above). The shape of the ribs could be part of a mold and the tube could be molded. The ribs could be machined on to the surface of the tubes (e.g. the ribs are created by machining away the gap between the ribs).

The cross section of the ribs may have a shape selected from a number of shapes such as a square, a triangle, a semi-circle and a semi-ellipse (semi-elliptical shape).

The tubes may be used in any application where a stream of reactants, typically fluid or liquid, preferably gas, needs to be heated. Some reactants include ethane, propane, butanes naphtha and gas oils and mixtures there of which are to be cracked and which may further include dilution steam. The tube may typically pass through a convection or convection/radiant heating zone. In such a heating zone a heat transfer medium, generally gaseous such as a gas selected from the group consisting of the combustion products of hydrogen, hydrocarbons, typically $C_{1-10}$, aliphatic or aromatic hydrocarbons or mixtures thereof. In one embodiment the hydrocarbons may be $C_{1-4}$ paraffins and mixtures thereof.

A particularly useful application for the ribbed tubes or pipes of the present invention is in furnace tubes or pipes used for the cracking of hydrocarbons (e.g. ethane, propane, butane, naphtha, and gas oils or mixtures thereof including dilution steam) to olefins (e.g. ethylene, propylene, butene, etc.). Generally in such an operation a feedstock (e.g. ethane) is fed in a gaseous form to a tube, pipe or coil typically having an outside diameter ranging from 1.5 to 8 inches (e.g. typical outside diameters are 2 inches (about 5 cm); 3 inches (about 7.6 cm); 3.5 inches (about 8.9 cm); 6 inches (about 15.2 cm) and 7 inches (about 17.8 cm). The tube or pipe runs through a furnace, typically a radiant furnace (which may have some amount of convection heat transfer), generally maintained at a temperature from about 900° C. to 1100° C. and the outlet gas generally has a temperature from about 800° C. to 900° C. As the feedstock passes through the furnace it releases hydrogen (and other byproducts) and becomes unsaturated (e.g. ethylene). The typical operating conditions such as temperature, pressure and flow rates for such processes are well known to those skilled in the art.

In a further embodiment of the present invention the tube may further comprise an internal surface modification to improve heat transfer such as a helical fin or bead or rifling or a combination thereof on the inside of the tube. One example of an internal spiral rib or bead is described for example in U.S. Pat. No. 5,950,718 issued Sep. 14, 1999 to Sugitani et al., assigned to Kubota Corporation. The fins or bead form a helical projection on the tube's inner surface. The angle of intersection of the fin or bead with the longitudinal tube axis is theta (θ), at a pitch (p) of the fins at S the circumference (S=πD where D is the inside diameter of the tube). The pitch p of the fin which is formed by a single helical projection or bead is equal to the distance of axial advance of a point in the helical projection for a complete turn about the tube axis, (i.e., lead L=πD/tan θ). The pitch (p) of the helical fin can be optionally determined as the spacing (axial distance) between the adjacent helical projections. Generally the internal fin(s) may have a height from 1 to 15 mm, a pitch from 20 to 350 mm at an intersection angle (θ) from 15° to 45°, preferably from 25° to 45°.

Without being bound by theory it is believed that when a stream of hot fluids or gases passes over the ribs of the present invention a swirling turbulence is created in the fluid at the surface of the pipe. This tends to improve the conductive heat transfer from the fluid as a new surface of the conductive fluid is contacting the tube or rib (e.g. causes a reduction in the boundary layer).

The present invention will now be illustrated by the following examples/simulations.

EXAMPLES

For the purposes of the modeling Applicants used computational fluid dynamics (CDF) techniques using Fluent® software for a 3 dimensional mesh having 85,000 grid cells to represent the surface of the tube.

The steady-state heat transfer for an element of a coil furnace tube is frequently expressed in terms of an overall heat transfer coefficient U, defined by the relation:

$$q=UA\Delta T \tag{1}$$

where A is some suitable area for heat transfer. Using, an electrical resistance analogy (FIG. 1), the above equation can be written as:

$$q=\frac{2\pi l(T_o-T_i)}{\frac{1}{\left[h_o+\frac{F_s\varepsilon_g\sigma T_o^4-F_s\varepsilon_{g/w}\sigma T_{w,o}^4}{T_o-T_{w,o}}\right]r_o}+\frac{\ln(r_o/r_i)}{k}+\frac{1}{h_i r_i}} \tag{2}$$

where $h_o$ and $h_i$ are the external and internal convective heat transfer coefficients, respectively, k is the thermal conductivity of the wall, $F_s$ is a shape factor, $\epsilon_g$ and $\epsilon_{g/w}$ are gas emmissivity and gas absorbtivity parameters, respectively, σ is the Stefan-Boltzmann constant and $T_{w,o}$ is the wall temperature at the outer surface of the tube. The three terms in the denominator represent the heat transfer resistance of the external surface $R_o$, tube wall $R_w$ and internal surface $R_i$, respectively. Equation (2) must be solved iteratively, along with equation (3) below, since the wall temperature at the outer surface of the tube, $T_{w,o}$, is unknown.

$$q=2\pi r_o l[h_o(T_o-T_{w,o})+F_s\epsilon_g\sigma T_o^4-F_s\epsilon_{g/w}\sigma T_{w,o}^4] \tag{3}$$

The convective heat transfer coefficient for the outer tube wall, $h_o$, can be estimated from the expression for free convection from vertical tubes [13]

$$h_o=1.42\left(\frac{T_o-T_{w,o}}{l_p}\right)^{1/4} \tag{4}$$

where $l_p$ is the vertical tube length of a single tube pass.

To estimate the convective heat transfer coefficient along the internal tube wall $h_i$, the following relation for smooth pipes can be used $$h_i=0.023Re^{0.8}Pr^{0.4} \tag{5}$$

where all the properties are calculated at the bulk temperature of the process gas inside the tube. Typical conditions for a commercial ethane cracking furnace are given in Table 1.

TABLE 1

Typical Commercial Furnace Conditions For An Ethane-Ethylene Cracker

| Parameter | Value |
|---|---|
| Process (Ethane) Gas Temperature | 700° C. |
| Furnace Flue Gas Temperature | 1400° C. |
| Ethane Density | 0.6 kg/m$^3$ |
| Ethane Thermal Conductivity | 0.15 W/m K |
| Ethane Reynolds Number | 600,000 |
| Ethane Prandtl Number | 0.82 |
| Ethane Mass Flow Rate | 5 tonnes/hour |
| Shape Factor | 0.15 |
| Flue Gas Emmissivity Parameter | 0.5 |
| Flue Gas Absorbtivity Parameter | 0.7 |
| Tube Inner Radius | 76.2 mm |
| Tube Outer Radius | 82.4 mm |
| Tube Length | 12 m |
| Tube Thermal Conductivity | 30.0 W/m K |

For the furnace conditions given in Table 1, the three resistances are estimated to be:

$R_o$=0.0430 m K/W $R_w$=0.000415 m K/W $R_i$=0.00238 m K/W

Validation of Computational Fluid Dynamic Study

To validate the computational model it was run to simulate the case of internal transverse ribs having an e/D=0.02 and P/e=40. The calculations were compared to data presented in Webb, R. L., Eckert, E. R. G. & Goldstein, R. J. Heat Transfer And Friction In Tubes With Repeated-Rib Roughness. *Int. J. Heat Mass Transfer*, Vol. 14, pp. 601–617, 1971.

The results of the calculations using the computational model and the actual results presented in the above noted paper are presented in Table 2.

TABLE 2

CFD Validations of Friction Factor in a Tube with Internal Repeated Transverse Ribs

| | Friction Factor | |
|---|---|---|
| | Experimental | CFD |
| Smooth Pipe | 0.00665 | 0.00696 |
| Internal Transverse Ribbed Pipe (e/D = 0.02; P/e = 40) | 0.0159 | 0.0151 |

Since the internal flow was modeled to within 5% of the actual flow and it was concluded that CFD modeling should be sufficiently accurate for the proposed external modifications.

EXPERIMENT 1

In the first part of this study, the rib height, rib spacing and rib thickness for square ribs was varied. The overall results are shown in Table 3 below. For the first case (1), the ribs are spaced too closely together (P/e) and a recirculation region spanning the gap between the ribs is set up, thus reducing the effectiveness of the ribs. In the second case (2), there is a reattachment point to the convection flow in the furnace between the ribs, thus giving better results. When the rib spacing was increased even further (case 3), the increase in heat flux started to decrease, due to the large distance between ribs. These results indicate that an almost 20% increase in convective/conductive heat transfer is possible with external ribs, and greater increases should be possible with optimization of the rib geometry.

Next, the relative rib height e/D was reduced by half (cases 4 and 5) which resulted in very marginal increases in heat flux. This was due to the insignificant impact of the small ribs on the external flow field around the tube.

TABLE 3

CFD Study of Convective Heat Transfer with Square External Transverse Ribs

| Case | e/D | P/e | t/e | % Change in Heat Flux | Temperature Change |
|---|---|---|---|---|---|
| 1 | 0.150 | 4 | 1 | 8.9 | 9° C. |
| 2 | 0.150 | 8 | 1 | 18.5 | 13° C. |
| 3 | 0.150 | 16 | 1 | 16.5 | 10° C. |
| 4 | 0.077 | 10 | 2 | 2.1 | 5° C. |
| 5 | 0.077 | 6 | 2 | 0.64 | 3° C. |

The temperature change listed in Table 3 refers to the maximum difference in temperature between the inside and outside of the tube wall. A higher temperature difference indicates a more pronounced effect of the external heat transfer.

EXPERIMENT 2

Figure 2:
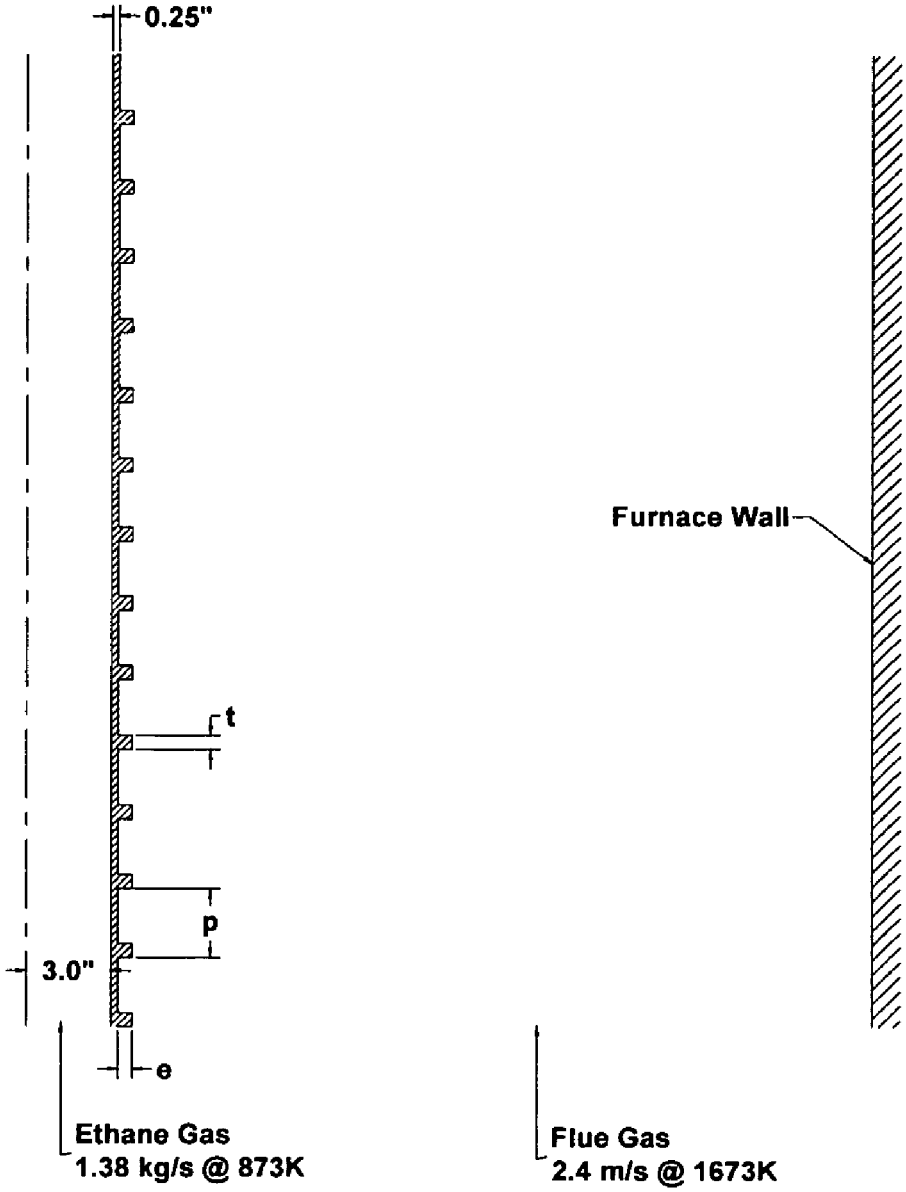
FIG. 2 is a computational domain of transverse external repeated ribs for Ø6 inch tube—square ribs. The flue gas is ascending between the furnace wall and exterior of the furnace tube at 2.4 m/s @1673 K. The ethane gas is ascending through the tube at 1.38 kg/s @873 K.

Next, a comparison of rib geometry with a constant rib height, thickness and spacing was conducted. Square, semi-circular and triangular ribs of the geometry shown in FIG. 2 were simulated and the results are given in Table 4. The semi-circular and triangular shapes were chosen since they may be easier to manufacture with an external coating procedure.

TABLE 4

CFD Comparison of Convective Heat Transfer for Square, Semi-Circular and Triangular External Transverse Ribs

| Case | Rib Geometry | e/D | P/e | t/e | % Change in Heat Flux |
|---|---|---|---|---|---|
| 5 | Square | 0.077 | 6 | 2 | 0.64 |
| 6 | Semi-circular | 0.077 | 6 | 2 | 5.4 |
| 7 | Triangular | 0.077 | 6 | 2 | 5.4 |

The square ribs are so poor because they don't allow the furnace gas to penetrate between the ribs, contrary to the other two geometric configurations. In addition, the triangular ribs have the smallest temperature gradient from rib root to tip, followed closely by the semi-circular case; the square ribs have the largest root-to-tip temperature gradient.

EXPERIMENT 3

Figure 3:
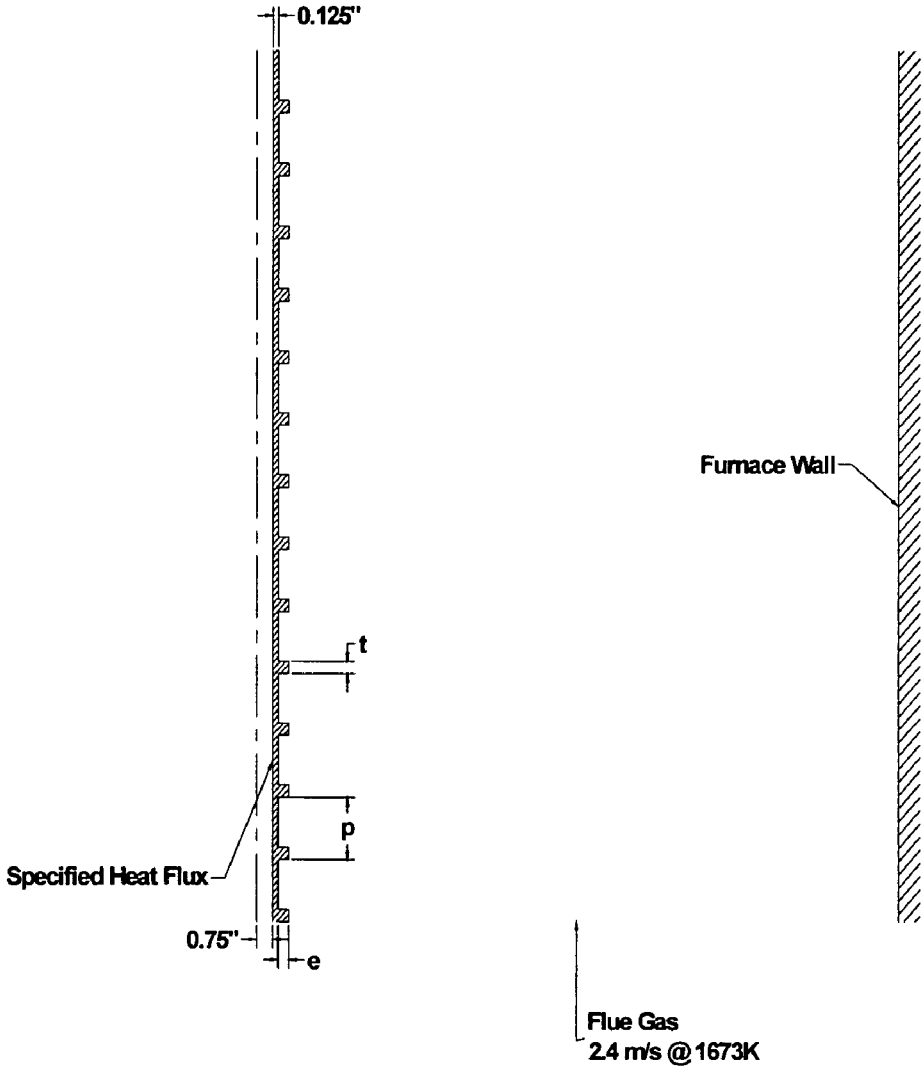
FIG. 3 is a computational domain of transverse external repeated ribs for Ø1.5 inch tube—semi-circular ribs under the same conditions as FIG. 2.

In order to assess the effect of external ribs on smaller tube sizes, a few simulations with semi-circular ribs on a smaller tube size (Ø1.5 inch) were carried out. Geometry of the computational domain is provided in FIG. 3 and the simulation results are given in Table 5.

TABLE 5

CFD Comparison of Convective Heat Transfer for Semi-Circular External Transverse Ribs and Different Tube Sizes

| Case | Tube Diameter | e/D | P/e | t/e | % Change in Heat Flux |
|---|---|---|---|---|---|
| 6 | Ø6 inch | 0.077 | 6 | 2 | 5.4 |
| 8 | Ø 1.5 inch | 0.0715 | 6 | 2 | 3.4 |
| 9 | Ø 1.5 inch | 0.0715 | 10 | 2 | 5.1 |

These results indicate similar trends for rib spacing (i.e. the larger spacing results in better heat transfer) but the smaller tube has a slightly smaller heat transfer increase than the larger tube, for the same relative geometric conditions, likely due to the thinner tube wall (0.125 inch vs. 0.25 inch).

EXPERIMENT 4

Finally, the effect of radiation was considered for case 2 of the square rib geometry. The furnace wall was assumed to have an emmissivity of 0.9 and the tube 0.6. The result is given in Table 6.

TABLE 6

CFD Predictions of Heat Transfer With and Without Radiation on Square External Transverse Ribs

| Radiation Model | | Heat Flux (W) |
|---|---|---|
| Discrete Ordinates | Smooth Tube (5.0 m long) | 428,145.6 |
| Discrete Ordinates | Ribbed Pipe (e/D = 0.15; P/e = 8; t/e = 1) | 441,324.7 (+3.1%) |

TABLE 6-continued

CFD Predictions of Heat Transfer With and Without Radiation on Square External Transverse Ribs

| Radiation Model | | Heat Flux (W) |
|---|---|---|
| None | Smooth Tube (5.0 m long) | 8311.9 |
| None | Ribbed Pipe (e/D = 0.15; P/e = 8; t/e = 1) | 9848.8 (+18%) |

The overall result is relatively consistent with the 1D heat transfer analysis, which indicated that the percentage increase in convective heat transfer would result in an overall heat transfer increase of roughly 1/10 the convective heat transfer increase. However, the level of heat transfer relative to the case without radiation is far too high. This is likely due to the radiation heat transfer model used in Fluent, which can give erroneous results if the emmissivity and wall models are not accurate.

CONCLUSIONS

The results of a parametric heat transfer study—using CFD—for a furnace tube with external transverse repeated ribs indicate that a 20% increase in convective/conductive heat transfer is possible with external ribs. This results in a 3–5% increase in the overall heat transfer efficiency of the furnace tube system.

What is claimed is:

1. A method to increase by at least 5% the convection heat transfer from an external fluid heat transfer medium to a vertical surface selected from the group consisting of metal or ceramic in a radiant fired heater box, and increasing the total heat flux into the surface by at least 2% used to heat an internal process fluid by increasing the turbulent flow of the fluid heat transfer medium at the external surface comprising forming on the external surface ribs which have:

(i) a ratio of the rib height to the diameter of the tube (e/D) from 0.05 to 0.35;

(ii) a ratio of the distance between the leading edge of consecutive ribs to rib height (P/e) less than 40; and (iii) a ratio of the thickness of the rib to the height of the rib (t/e) from 0.5 to 3.

2. The method according to claim 1, wherein the rib has an e/D ratio from 0.1 to 0.25.

3. The method according to claim 2, wherein the rib has a P/e ratio from 2 to 20.

4. The method according to claim 3, wherein the rib has a t/e ratio from 1 to 2.

5. The method according to claim 4, wherein the rib has a cross section profile selected from the group consisting of a square, a triangle, semi-circular and semi-elliptical.

6. The method according to claim 5, wherein the surface is selected from the group consisting of stainless steel, cast alloys, wrought alloys, carbon steel and ceramic.

7. The method according to claim 6, wherein the surface is one or more tubes.

8. The method according to claim 7, wherein said one or more tubes have an external diameter up to 8 inches.

9. The method according to claim 8, wherein the external fluid heat transfer medium is a gas selected from the group consisting of the combustion products of hydrogen, hydrocarbons and a mixture thereof.

10. The method according to claim 9, wherein the internal process fluid is selected from the group consisting of ethane, propane, butane, naphtha, gas oils, dilution steam, and mixtures thereof.

11. The method according to claim 10, having an internal surface resistant to coking.

12. The method according to claim 10, wherein the rib has a P/e ratio from 4 to 16.

13. The method according to claim 12, wherein the convection heat transfer is increased by at least 8%.

14. The method according to claim 13, wherein the rib has a triangular, semi-circular or semi-elliptical cross section profile.

15. The method according to claim 14, wherein the rib is horizontal.

16. The method according to claim 14, wherein the rib is helical.

17. The method according to claim 15, wherein said one or more tubes have an internal surface resistant to coking.

18. The method according to claim 17, wherein one or more tubes further have one or more internal modifications to increase heat transfer.

19. The method according to claim 16, wherein said one or more tubes have an internal surface resistant to coking.

20. The method according to claim 19, wherein said one or more tubes further have one or more internal modifications to increase heat transfer.

21. A tube used in a chemical reaction requiring the input of heat to the reaction having on the external surface of the tube ribs which have:

(i) a ratio of the rib height to the diameter of the tube (e/D) from 0.05 to 0.35;

(ii) a ratio of the distance between the leading edge of consecutive ribs to rib height (P/e) less than 40; and (iii) a ratio of the thickness of the rib to the height of the rib (t/e) from 0.5 to 3.

22. The tube according to claim 21, made from a material selected from the group consisting of stainless steel, cast alloys, wrought alloys, carbon steel and ceramic.

23. The tube according to claim 22, having an e/D ratio from 0.1 to 0.25.

24. The tube according to claim 23, having a P/e ratio from 2 to 20.

25. The tube according to claim 24, having a t/e ratio from 1 to 2.

26. The tube according to claim 25, wherein the rib has a cross section profile selected from the group consisting of a square, a triangle, semi-circular and semi-elliptical.

27. The tube according to claim 26, wherein the rib has a triangular, semi-circular or semi-elliptical cross section profile.

28. The tube according to claim 27, wherein the rib is horizontal.

29. The tube according to claim 27, wherein the rib is helical.

30. The tube according to claim 28, having an internal surface resistant to coking.

31. The tube according to claim 28, wherein the tube further has one or more internal modifications to increase heat transfer.

32. The tube according to claim 31, wherein the tube further has one or more internal modifications to increase heat transfer.

33. The tube according to claim 29, having an internal surface resistant to coking.

34. The tube according to claim 29, wherein the tube further has one or more internal modifications to increase heat transfer.

35. The tube according to claim 34, wherein the tube further has one or more internal modifications to increase heat transfer.

36. A process to make a rib on a metal tube according to claim 22, comprising one or more processes selected from the group consisting of casting, machining, and welding.

37. A process to make a rib on a metal tube according to claim 22, comprising depositing additional material.

38. A process to make a rib on a ceramic tube according to claim 22, comprising one or more processes selected from the group consisting of casting, and machining.

39. A process to make a rib on a ceramic tube according to claim 22, comprising depositing additional material.

* * * * *